US008594865B1

(12) United States Patent
Matusiak et al.

(10) Patent No.: US 8,594,865 B1
(45) Date of Patent: Nov. 26, 2013

(54) TRAIN CONTROL SYSTEM

(75) Inventors: Richard J. Matusiak, Watertown, NY (US); Wade Goforth, Carrollton, TX (US); Folkert Horst, Ottawa (CA)

(73) Assignee: New York Air Brake Corporation, Watertown, NY (US)

( * ) Notice: Subject to any disclaimer, the term of this patent is extended or adjusted under 35 U.S.C. 154(b) by 0 days.

(21) Appl. No.: 13/474,132

(22) Filed: May 17, 2012

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.
USPC ..... 701/20; 701/19

(58) Field of Classification Search
USPC ..... 701/20, 22, 16, 52, 19, 70, 51, 28; 180/23
See application file for complete search history.

(56) References Cited

U.S. PATENT DOCUMENTS

| | | | | |
|---|---|---|---|---|
| 3,380,399 | A | 4/1968 | Southard et al. | |
| 4,344,364 | A | 8/1982 | Nickles et al. | |
| 5,570,284 | A | 10/1996 | Roselli et al. | |
| 7,447,571 | B2 * | 11/2008 | Nickles et al. | 701/20 |
| 8,090,486 | B2 * | 1/2012 | Meyer et al. | 701/20 |
| 8,095,253 | B2 * | 1/2012 | Kane et al. | 701/20 |
| 8,126,601 | B2 * | 2/2012 | Kapp et al. | 701/20 |
| 8,229,607 | B2 * | 7/2012 | Hrdlicka et al. | 701/20 |
| 8,249,763 | B2 * | 8/2012 | Brooks et al. | 701/20 |
| 8,370,007 | B2 * | 2/2013 | Brooks et al. | 701/20 |
| 8,398,405 | B2 * | 3/2013 | Kumar | 434/66 |
| 2004/0133315 | A1 * | 7/2004 | Kumar et al. | 700/302 |
| 2007/0219682 | A1 * | 9/2007 | Kumar et al. | 701/19 |
| 2007/0225878 | A1 * | 9/2007 | Kumar et al. | 701/19 |
| 2007/0233335 | A1 * | 10/2007 | Kumar et al. | 701/22 |
| 2010/0023190 | A1 * | 1/2010 | Kumar et al. | 701/20 |
| 2010/0262321 | A1 * | 10/2010 | Daum et al. | 701/20 |
| 2012/0310453 | A1 * | 12/2012 | Brooks et al. | 701/20 |

* cited by examiner

*Primary Examiner* — Thomas Black
*Assistant Examiner* — Robert Payne
(74) *Attorney, Agent, or Firm* — Barnes & Thornburg LLP

(57) ABSTRACT

A train control system, in particular to a train control system for a train consist using a Distributed Power (DP) technology. This technology refers to the placement and operation of one or more groups of locomotives, which are distributed throughout a train consist including a multiple railcars and multiple locomotives. These locomotives are remotely controlled from the cab in the leading locomotive (i.e., the Lead locomotive (LL)).

14 Claims, 4 Drawing Sheets

TRAIN CONTROL SYSTEM

BACKGROUND

The disclosed embodiments relate to a train control system, in particular to a train control system for a train consist using a Distributed Power (DP) technology. This technology refers to the placement and operation of one or more groups of locomotives, which are distributed throughout a train consist including a plurality of railcars and a plurality of locomotives. These locomotives are remotely controlled from the cab in the leading locomotive (i.e., the Lead Locomotive (LL)).

It is known that the locomotives distributed throughout a consist can be operated by two different operation modes. The first mode is a synchronous operation mode, which refers to the situation where all locomotives are operated such that they perform the same operations input by the operator located in the cab of the LL. The second mode is an independent operation mode, in which the operator of the Lead Locomotive controls each one (or groups/subsets of the total number) of the locomotives separately.

Use of DP to drive a train has significantly contributed to the increased complexity of operating a train consist and also moved the workload of the train operator to a higher level. The task to operate the train consist in an optimum manner with regard to in-train forces (e.g., maintaining low continuous and instantaneous forces) and fuel economy is very complex and demanding to the train operator.

As a result, the implementation of DP conventionally causes several problems. For example, due to the above mentioned increased workload and the higher attention of the train operator, which is necessary for operating a DP train, the operator may be distracted and operation safety may be compromised. Further, optimization of fuel-efficiency and the reduction of in-train forces cannot be mentally determined by the operator alone. Even in the case that a computer calculating the optimum settings for a brake/propulsion system in the independent operation mode and displays them to the operator, the operator still must set the input according to which the different locomotives are being operated.

SUMMARY

Accordingly, the disclosed embodiments relates generally to an improved approach to providing control of a DP system and more specifically to an intelligent DP system with a driver assist DP mode.

The train control system for DP driven trains according to the disclosed embodiments can solve these conventional problems. In accordance with disclosed embodiments, a Lead Locomotive (LL) and at least one Remote Locomotive (RL) are both controlled via the train control system. The train control system includes an operator interface located in a cab of a locomotive, for example, the cab of the LL, to receive input by a train operator. The operator interface is implemented at least in part using at least one computer that connected to a network, which is configured to enable transmission of locomotive-specific brake and/or throttle commands to each locomotive in the consist.

The computer receives the operator's input via the operator interface and includes software that is configured to determine braking values and throttle values for each locomotive within the consist based on the operator's input to the operator interface and on at least one of the track profile information, train consist information and temporary speed restriction information.

The braking and throttle values determined for each of the plurality of locomotives are optimized by the onboard computer in view of the train's fuel conservation, the reduction of in-train forces and/or maintaining the average train velocity and are output to the locomotives distributed in the consist to assist in controlling the train.

The intelligent DP system provided in accordance with at least one disclosed embodiment is capable of three operating modes, including the conventionally known synchronous operation mode and independent operation mode but also including a driver-assist DP mode. In such an implementation, in driver-assist DP mode, the operator needs only to input a single set of control inputs pertaining to operation of the LL while the computer automatically translates that set of instructions into corresponding control inputs, e.g., propulsion/braking controls, for each of the RLs, wherein the translated control inputs to the RL are calculated to minimize in-train forces and/or maximize fuel economy within selected parameters.

With this train control system, it is possible to match or outperform (e.g., including reduction to engineer workload) the advantages of both the conventional synchronous and independent operation. Additionally, the train control system provides improved ease of operation for the engineer because the engineer is not tasked with attempting the complex analysis associated with determining, or at least estimating in-train forces and the like for each of the locomotives. This is because the engineer only interacts with the interface in the same manner as in synchronous mode operation and there is no need for the operator to input settings for the different locomotives.

In addition, the fuel conservation can be further increased and in-train forces can be further reduced with respect to the manually performed independent operation mode because the computer can properly determine the throttle and braking commands based on of the operator's input to the operator interface and on at least one of the track profile information, train consist information and temporary speed restriction information, the car load, braking effort, drawbar/draft gear forces and impact detection. As a result, the overall complexity of operating a DP train is reduced, thereby potentially reducing the training requirements necessary to operate the DP train.

BRIEF DESCRIPTION OF THE DRAWINGS

A more compete understanding of the present invention and the utility thereof may be acquired by referring to the following description in consideration of the accompanying drawings, in which like reference numbers indicate like features, and wherein.

DETAILED DESCRIPTION

Figure 1:
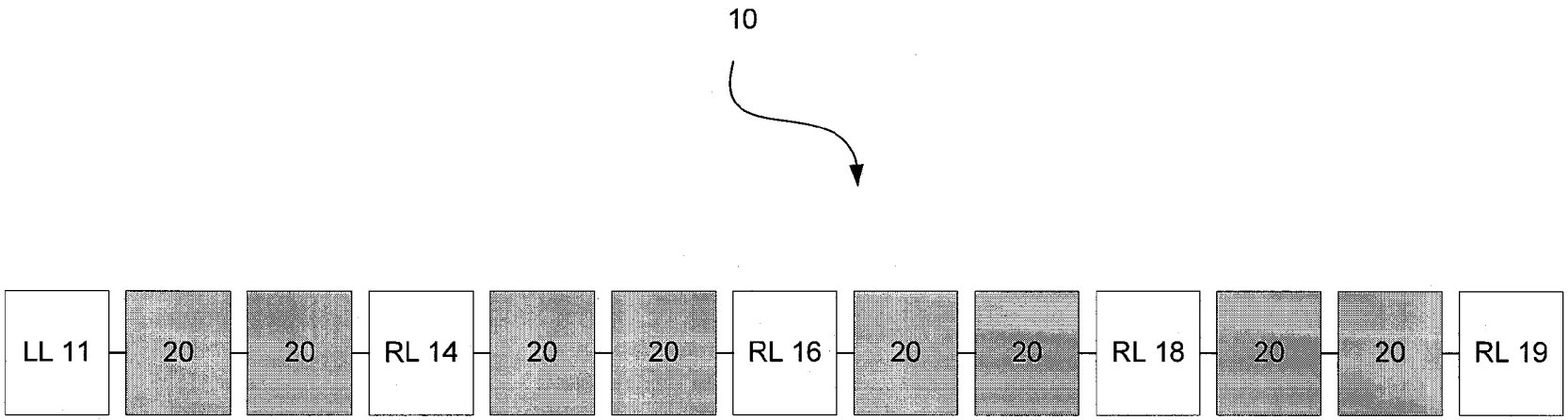
FIG. 1 is a diagram showing on illustrative example of a train consist.

Conventional DP systems generally include a master locomotive setting throttle/brake values and transmitting information (usually the Lead Locomotive (LL)) to slave locomotives (Remote Locomotives (RLs)) to set their throttle/brakes values (see, an example of an early system disclosed in U.S. Pat. No. 3,380,399 to Southard et al.). It is conventionally known for a RL to receive a throttle command from the LL and make a modification at the RL to that control setting to conserve fuel (see, U.S. Pat. No. 4,344,364 to Nickles et al., incorporated by reference in its entirety) Additionally, the ability of the RL to transmit back diagnostic information to the LL is also known (see U.S. Pat. No. 5,570,284 to Roselli et al.)

However, conventional DP systems fail to provide a mode of operation where the engineer can input a single set of command inputs like in a synchronous mode of operation, which is then translated into RL specific commands and transmitted to the respective RLs in the train consist. Disclosed embodiments provide such a driver-assist DP mode.

Moreover, the driver-assist DP mode is also capable of determining the RL specific propulsion/brake values based on the topography and location of the each and all of the locomotives in the consist as an extension to the technology disclosed in U.S. Pat. No. 6,144,901 to Nickles et al. (incorporated by reference in its entirety).

In accordance with the disclosed embodiments, the intelligent DP system includes, on each locomotive, a propulsion system and a braking system as well as a transceiver for communication between the locomotives (RL to LL, LL to RL and RL to RL). The locomotive-specific equipment also includes various sensors for sensing operational conditions on the respective locomotive as well as a computer processor, hard-wired, integrated circuit (with specific application functionality, or the like, that is provided and configured to receive the sensed operational conditions for the locomotive, perform any necessary on-locomotive processing, and to communicate information including the sensed operational conditions to at least one and potentially more than one (e.g., all) the other locomotives.

Unlike a conventional DP system, the processors for the RLs do not determine their own propulsion or braking value/command based on the sensed operational conditions, pre-selected criteria or information when the DP system is in the driver-assist DP mode. Rather, the computer processor provided in the LL (acting as the master locomotive), determines the propulsion and braking values/commands for each of the RLs based on the sensed operation conditions provided by each of the RLs, pre-selected criteria, and the information received from the other locomotives, and transmits the RL-specific propulsion or braking value/commands to each of the RLs for implementation.

Thus, when the intelligent DP system is being operated in the driver-assist DP mode, the computer processor of the LL performs operations to determine and communicate to the other locomotives, the translated initial propulsion/braking values, based on the driver's single set of control inputs on board the LL and also based on pre-selected criteria and sensed operation conditions sensed by the sensors on board the LL and received from the other RLs. Likewise, the computer processor for the LL may also perform operations to determine and communicate to the other locomotives, the translated final propulsion/braking values based on the driver's single set of control inputs and also based on pre-selected criteria and sensed operational conditions sensed by the sensors on board the LL and received from the other RLs.

As part of the operations performed to provide the translated propulsion/braking commands for each RL based on the driver's input during driver assist DP mode, the computer processor on the LL may determine topology of the present and projected location of each locomotive, determine a translated initial propulsion/braking value using the topology of the present and projected location of each locomotive and pre-selected criteria, determine a translated final propulsion or braking value/command based on the initial value and the information received from one or more RLs, and transmit translated control propulsion/braking values/commands to one or more (and optionally, each and all) of the RLs.

As shown in FIG. 1, train consist 10 includes a plurality of locomotives 11, 14, 16, 18 and 19 with a plurality of cars 20. One of the locomotives is designated a LL, i.e., 11, and the others are considered trail and/or remote locomotives. Thus, in the industry, if locomotive 11 is the lead, locomotives 14, 16, 18 and 19 are RLs. As explained above, and discussed below with reference to FIG. 3, each of the locomotives 11, 14, 16, 18, and 19 include a computer processor. Depending on the role and position of the locomotives within a train consist and the mode of operation that the train consist is running in, the operations of each processor will differ.

Thus, in accordance with the disclosed embodiments, if the train consist 10 is being operated in synchronous mode, the driver's input control commands (i.e., propulsion/braking commands) input at the LL 11, are transmitted and applied, as is, to the RLs 14, 16, 18 and 19. If the train consist 10 is being operated in independent operation mode, the driver provides separate sets of propulsion/braking commands for each of (or groups/subsets of the total number) the locomotives including the LL 11 and RLs 14, 16, 18 and 19.

However, when the train consist is being operated in driver-assist DP mode, the computer processor or the like translates the driver's single set of propulsion/braking commands into locomotive-specific sets of propulsion/braking commands for each RL based on the command set and pre-selected criteria and sensed operational conditions sensed by the sensors on board the LL and received from the other RLs and, optionally, based on determined topology of the present and projected location of each LL.

Thus, in accordance with at least one embodiment, the driver-assist DP mode may be implemented such that, the operator needs only to input a single set of control inputs pertaining to operation of the LL while the computer automatically translates that set of instructions into corresponding control inputs, e.g., propulsion/braking controls, for each of the RLs, wherein the translated control inputs RL are calculated to minimize in-train forces and/or maximize fuel economy within selected parameters.

It should be appreciated that this automatic translation may be implemented in a number of different ways. For example, the single set of control inputs could be implemented to exactly control the LL (or lead group of locomotives) and the computer processor(s) or the like could also formulate additional control inputs to for RLs (or RL groups) to reduce in-train forces and/or increase fuel efficiency. Alternatively, the single set of control inputs could be analyzed prior to implementing such control inputs at the LL (or LL group) and the computer processor(s) or the like could translate the single set of control inputs into a translated set of control instructions for each, all or some subset of the locomotives on the train. Therefore, if an engineer were to change a throttle setting from three to four on the LL; the resulting implemented changes on the locomotives within the train may be different depending on implementation of the embodiments.

Thus, for example, in one embodiment implementation, the LL (or LL group) may experience the exact instruction (changing the throttle setting from three to four), while the processor may translate the input control to formulate complimentary control commands at the RLs (or RL groups) to minimize in-train forces and/or improve fuel efficiency.

Alternatively, rather than implement the control input for the LL (or LL group) with complimentary controls being translated for RLs (or RL groups), at least one embodiment may translate the LL control input to formulate corresponding control commands that implement the effect of the operator's input command (e.g., increased traction to be experienced by the train), but in a manner that may be determined to be more fuel efficient or minimize or reduce in-train forces).

It should be appreciated that both implementations are within the scope of the disclosed embodiments.

A processor, such as the processor 405 illustrated below in FIG. 4, may perform the method illustrated in FIG. 2. The method begins at 200 and control proceeds to 205 at which the configuration of the train consist(s) is determined, to determine the location and identification of locomotives within the consist and the identification and weight of cars within the train consist (if known). Subsequently, control proceeds to 210, at which a determination is made as to what mode of operation the intelligent DP system is in. Based on that determination, at 215, the processor operates corresponding subroutines (synchronous mode subroutine 220, independent operator subroutine 225) that are conventionally known (and therefore, not discussed further herein).

However, if it is determined that the system is operating in driver-assist DP mode, control proceeds to 230 for performance of the driver-assist mode subroutine. Control of the main processing functions continues to 235, while operations are performed for the presently selected subroutine, to ensure that the system monitoring and detects a change in the mode of operation for the system.

Figure 3:
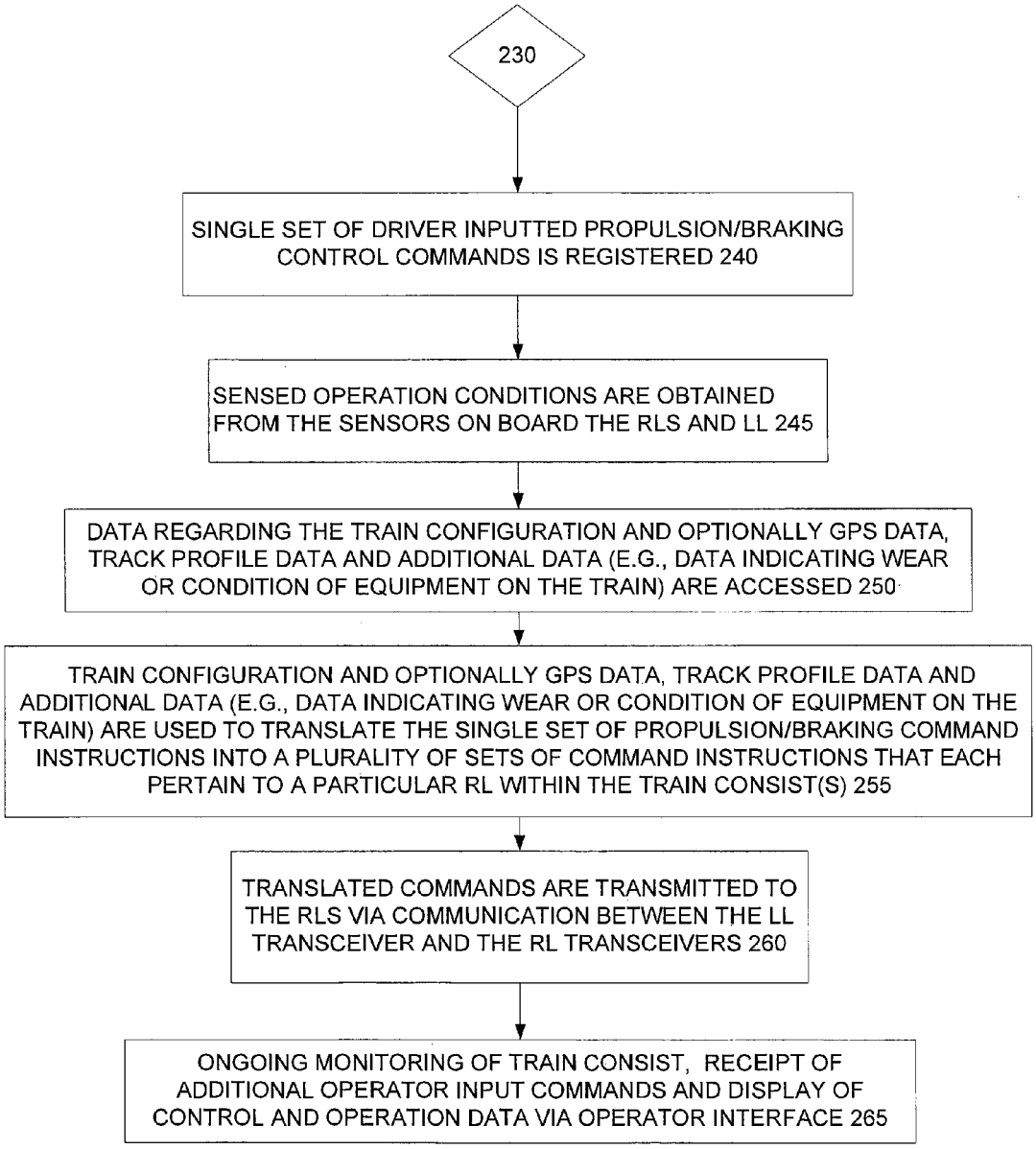

As shown in FIG. 3, the driver-assist subroutine begins at 240 at which sensed operation conditions are obtained from the sensors on board the RLs and LL (as well as optionally, from cars such as 20, illustrated in FIG. 1). Control then proceeds to 245, at which a single set of driver inputted propulsion/braking control commands is registered; that set of commands pertains to how the driver intends the LL to be operated. However, since the intelligent DP system is in driver-assist DP mode, the driver should recognize that the RLs will be operated based on a translated set of control commands that are specific to each RL.

Control then proceeds to 250 at which data regarding the train configuration and optionally GPS data, track profile data and additional data (e.g., data indicating wear or condition of equipment on the train) are accessed from on-board or remotely located (e.g., off train) databases). Subsequently, control proceeds to 255 at which that data are used to translate the single set of propulsion/braking command instructions into a plurality of sets of command instructions that each pertain to a particular RL within the train consist(s). Subsequently, at 260, the translated commands are transmitted to the RLs via communication between the LL transceiver and the RL transceivers. Thereafter, conventional train consist monitoring and display of data to the train operator are performed along with the novel receipt and processing of additional commands from the train operator at 265. Handling of subsequent commands is also based on the mode of operation that the LL is operating in.

Figure 2:
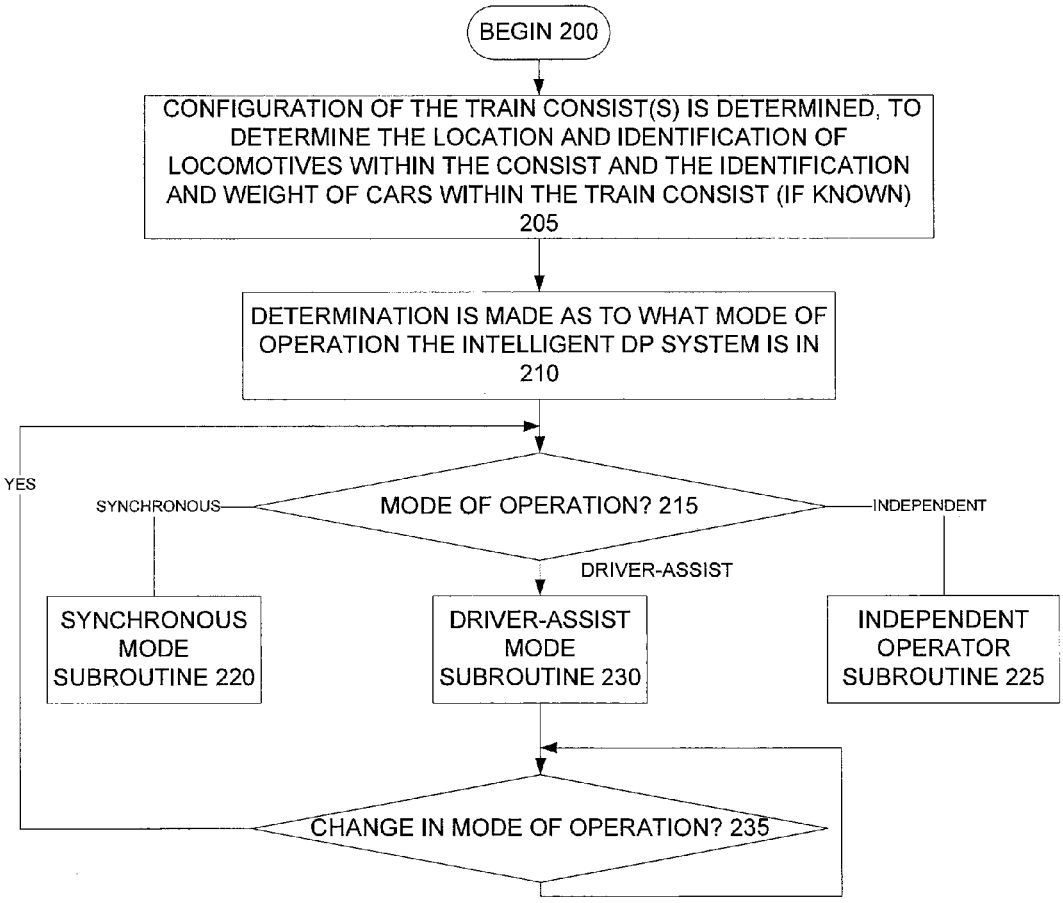
FIGS. 2-3 illustrate a methodology for performing a method of improved DP train control in accordance with at least one embodiment.

Although operations illustrated in FIG. 2 indicate that the operations are performed in a serial manner, it should be understood that some or all of the operations may be performed in parallel, wherein translation of the single set of LL command instructions is performed on a continuous basis taking into account ever changing GPS and track profile constraints on the train consist configuration. Additionally, it should be understood that these operations may continue until train operation is ceased or the driver changes the mode of operation of the intelligent DP system.

The LL and RLs may communicate by radio or by wire. The commands entered by the driver at the LL and, depending on the operation, are either transmitted or translated and transmitted to the RLs. Those commands include, for example, setting the direction control, setting the throttle, set up dynamic braking, set up the operating modes, interlock dynamic brakes, as well as turning on and off various ancillary functions.

Regardless of the mode of operation that the train consist is operating in, the processors on-board the RLs are configured to transmit status messages or exception message back to the LL as circumstances warrant. Such a status message may include, for example, locomotive identification, operating mode and tractive-braking efforts. Exception messages may include various fault alerts such as wheel slip, locomotive alarm indicator, incorrect brake pressure, low main reservoir pressure, throttle setting, etc.

Figure 4:
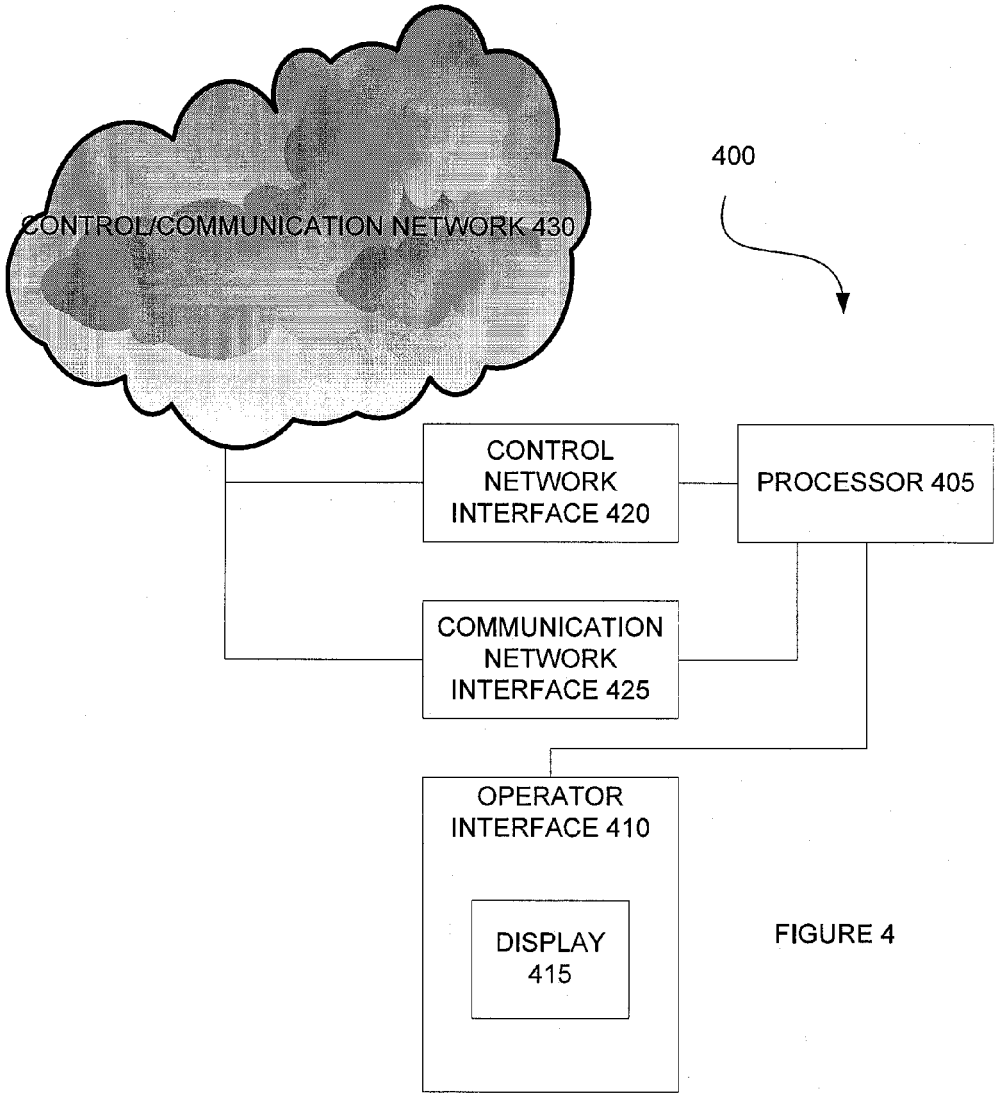
FIG. 4 is a schematic representation of train specific command and control equipment coupled to and communicating via a command/control network coupling the locomotives of a train consist(s) together.

As shown in FIG. 4, on-locomotive, locomotive-specific equipment system 400 includes a number of subsystems each with specific duties. FIG. 4 shows a generic architecture. Recognizing that a locomotive may serve as a LL or an RL depending on needs, all locomotives includes the same hardware provided and configured to provide functionality as an LL or an RL.

Accordingly, as shown in FIG. 4, each of the locomotive specific system equipment 400 includes a processor 405 configured to perform the operations identified herein as being performed by the LL. Coupled to the processor is an operator interface 410, control network interface 420 and a communication network interface 425. The operator interface 410 that is provided with real-time display 415 of train operation data, and which may include a graphical and numerical representation of the current state of the train as shown in FIG. 5 of U.S. Pat. No. 6,144,901 (which is incorporated herein by reference). Likewise, the operator interface 410 is also configured to accept input commands from the train operator or driver.

Information may be entered via a key pad or touch screen on or associated with the real-time display 415 (which may be implemented, for example, using a wired communication source such as a laptop personal computer, tablet, or removable storage device) or via wayside radio communication.

The control network interface 420 and the communication network interface 524 may be implemented as the same component in some implementations or as separate implementations, where there is more than one network 430 for transmitting control commands and communication of sensed data.

Position of the train consist(s) and its locomotives may be determined from wheel movement sensors and a Global Positioning System (GPS) module (not shown). Further, an Input/Output (I/O) bus module (not shown) may gather all of the various locomotive parameters necessary for algorithm calculations for each of the modes of operation and reports the information to the computer processor 405 running the mathematical algorithms including the math models for each of the modes of operation. The processor 405 may be implemented as a high throughput capacity computer platform using a Real Time Operating System (RTOS); the processor 405 may perform the calculations required by the intelligent DP system algorithms and updating the real-time display 415. All of these sub-systems combine to form the intelligent DP System, which may encompass and control operation of at least two locomotives (at least one RL and a LL) but potentially many more.

Accordingly, each or both of the interfaces 420, 425 may include a transceiver to transmit and receive messages, which may be implemented as a radio frequency communication device between the locomotives and/or between locomotive consists included in a single train; alternatively, the same principles can be applied to communication along a wire where multiple communications may be taking place. Thus, for example, returning to FIG. 1, if there is a wire running throughout the train through locomotives 11, 14, 16, 18 and 19 and cars 20, and the locomotives form one network and the cars form another network, the same method may be used to allow private communication in either of the networks.

Math models used to translate the single set of LL entered driver control inputs into multiple, RL-specific sets of propulsion/brake values receive input from sensors throughout the train consist on both the RLs and the LL as well as, optionally, the rail cars 20. As a result, it should be understood that the math models implemented using software running on the processor operating in the LL use a plurality of parameters and performs calculations based on the current energy state of the train to create a real-time display of train dynamics.

Thus, the software's presentation of that data also provides information allowing the train crew to better control the train, minimizing loss of energy regardless of the mode of operation for the train. One example of a source of loss of energy is over-braking, which represents fuel unnecessarily consumed. Likewise, energy imparted to the cargo of the train represents potential damage to lading, equipment and rail. Both phenomena are undesirable and addressable using the intelligent DP system.

Communication may be established between the LL and the RL to report the necessary parameters from each of the locomotives necessary to perform calculations for each the above-described modes of operation.

It should be understood that the presently disclosed embodiments may be implemented with, in combination, in association or as part of a Wired DP system and/or any one of various commercially available LEADER components and systems available from New York Air Brake (NYAB) of Watertown, N.Y. Such components and systems facilitate real-time data collection, processing, storage and reporting and create a real-time, animated display of train dynamics in the cab for the locomotive engineer or driver. LEADER also provides the ability to recreate any run ever made for general or detailed post-analysis.

These LEADER components and systems provide the following informational benefits: Detailed, Real-Time View to Train Dynamics, Currently Occupied Grades and Curves, Slack State of all Couplers in Train, Air Brake Status of Train, Speed, Acceleration, and Position of Train, Complete Recording and Storage of all Data Necessary to Recreate Any Run at Any Time, Automatic Radio Download of Log Files for Analysis, Automatic or Manual Operational Analysis, Proactive Exception Reporting Via E-Mail, Flexible User Interface to Customize Analysis (By Segment, By Dates, By Engineer, By Exception, Or By Any Combination of the Above), Asset Tracking, Precise On-Board Tracking of Locomotive Location, Equipment Malfunction Alerts, and Integrated Train Control.

While this application has described innovation in conjunction with the specific embodiments outlined above, it is evident that many alternatives, modifications and variations will be apparent to those skilled in the art. Accordingly, the various embodiments, as set forth above, are intended to be illustrative, not limiting. Various changes may be made without departing from the spirit and scope of innovation.

For example, the system, methodology and components may be used to control a single train consist or multiple consists within a single train. Moreover, different consists within a train may be operating in different modes of operation and a LL operator may elect to command and control each train consist in a manner wherein each train consist is controlled like a single locomotive. Thus, for example, the consist when the driver is present is designated as the Lead Consist and all other consists are Remote Consists that may be operated in one of the three identified modes of operation.

Additionally, it should be understood that the functionality described in connection with various described components of various embodiments may be combined or separated from one another in such a way that the architecture or structure is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative orders and/or simultaneously.

Further, various disclosed components may be provided in alternative combinations operated by, under the control of or on the behalf of various different entities or individuals. It should also be understood that, in accordance with at least one embodiment, system components may be implemented together or separately and there may be one or more of any or all of the disclosed system components. Further, system components may be either dedicated systems or such functionality may be implemented as virtual systems implemented on general purpose equipment via software implementations.

It should also be understood that the presently disclosed embodiments represent a significant improvement in the manner in which distributed power control is implemented within one or more train consists. It should be appreciate that conventional Multiple Unit (MU) locomotive consists have sometimes been "wired" together (e.g., 27 pin MU cable) in such a way that throttle and dynamic brake commands from the train operator may be transmitted "along the wire" to all the locomotives within a consist; in this way, if the lead locomotive is set to throttle position #3 then all the trailing locomotive units would also receive the throttle position #3 command and respond accordingly.

Additionally, a conventional "consist management" approach uses an intelligent controller to modify the throttle position command in such a way that the tractive effort command (i.e., throttle position #3) may be distributed unevenly throughout the locomotive consist, for example the controller could decide that if the lead locomotive is requesting throttle position #3, rather than commanding all units to go to position #3, the last unit would be commanded to position #8 and the other locomotives would stay at IDLE. However, such consist management tools are based completely on rules relating to fuel efficiency and do not take into consideration track profile information or train consist information and do not aim to improve safety and reduce in-train forces (see, for example, U.S. Pat. No. 4,344,364 issued Aug. 17, 1982, and incorporated herein be reference in its entirety).

Accordingly, the presently disclosed embodiments extend beyond conventional approaches of controlling remote locomotives in a train by using the train consist and track profile information in making decisions to optimize fuel economy as well as train dynamics management.

As a result, it will be apparent for those skilled in the art that the disclosed embodiments are only examples and that various modifications can be made within the scope of the appended claims.

What is claimed:

1. A train control system for optimizing the control of a plurality of locomotives in a train consist including a Lead Locomotive and a plurality of Remote Locomotives, the system comprising:

an operator interface located on the Lead Locomotive that receives input braking and throttle commands from a train operator;

a control network connecting at least all locomotives and enabling transmission of throttle and brake commands to each locomotive, the control network being coupled to the operator interface; and a computer located onboard the Lead Locomotive that determines translated braking commands and throttle commands for each locomotive within the consist based on the operator input braking and throttle commands, the determination of the translated braking commands and throttle commands being made based on at least two of the track profile information, train consist information and temporary speed restriction information, wherein the translated braking and throttle values determined for each of the plurality of locomotives independently by the onboard computer are optimized in view of the train's fuel conservation, the reduction of in-train forces and maintaining the average train velocity and are output to each of the plurality of Remote Locomotives distributed in the consist to automatically control each of the plurality of Remote Locomotives in the train, wherein the train control system is capable of operating in a plurality of operation modes including a driver-assist DP mode, wherein receipt of an operator's input of a single set of braking and throttle commands pertaining to operation of the Lead Locomotive, and input via the operator interface, is automatically translated into corresponding braking and throttle commands for each of the Remote Locomotives, wherein the translated braking and throttle commands are calculated to minimize in-train forces and/or maximize fuel economy within selected parameters, wherein such translated braking and throttle commands are automatically implemented by each of the Remote Locomotives.

2. The system of claim 1, wherein the translated throttle and brake commands are locomotive specific.

3. The system of claim 1, wherein the determination of the translated braking data and the throttle commands for each locomotive is also affected by anticipated braking and throttle values of each of the plurality of locomotives based on upcoming track profiles.

4. The system of claim 1, wherein the determination of the translated braking data and the throttle commands for each locomotive is also affected by at least one of the car load, braking effort, drawbar/draft gear forces and impact detection.

5. The system of claim 1, wherein the operator interface is a control stand of the Lead Locomotive.

6. The system of claim 1, wherein the input braking and throttle control commands are implemented for the Lead Locomotive and used to determine the translated braking and input control commands that include complimentary control commands for Remote Locomotives that minimize in-train forces and/or improve fuel efficiency.

7. The system of claim 1, wherein the input braking and throttle control commands for the Lead Locomotive are used to determine the translated braking and input control commands that include corresponding control commands for both the Lead Locomotive and the Remote Locomotives to minimize in-train forces and/or improve fuel efficiency.

8. A train control method for optimizing the control of a plurality of locomotives in a train consist including a Lead Locomotive and a plurality of Remote Locomotives, the method comprising:

receiving input from a train operator via an operator interface located on the Lead Locomotive;

controlling throttle and braking of each of the locomotives via throttle and brake commands transmitted to each locomotive on a control network being coupled to the operator interface; and determining, on a computer located onboard the Lead Locomotive, braking commands and throttle commands for each of the locomotives within the consist based on the received input to the operator interface and at least two of track profile information, train consist information and temporary speed restriction information, wherein the braking and throttle values determined for each of the plurality of locomotives independently by the onboard computer are optimized in view of the train's fuel conservation, the reduction of in-train forces and maintaining the average train velocity and are output each of the plurality of Remote Locomotives distributed in the consist to automatically control each of the plurality of Remote Locomotives in the train, and wherein the train control method is capable of operating in a plurality of operation modes including a driver-assist DP mode, wherein receipt of an operator's input of a single set of braking and throttle commands pertaining to operation of the Lead Locomotive, and input via the operator interface, is automatically translated into corresponding braking and throttle commands for each of the Remote Locomotives, wherein the translated braking and throttle commands are calculated to minimize in-train forces and/or maximize fuel economy within selected parameters, wherein such translated braking and throttle commands are automatically implemented by each of the Remote Locomotives.

9. The method of claim 8, wherein the translated throttle and brake commands are locomotive specific.

10. The method of claim 8, wherein the determination of the translated braking and throttle commands for each locomotive is also affected by anticipated braking and throttle values of each of the plural locomotives based on upcoming track profiles.

11. The method of claim 8, wherein the determination of the translated braking and throttle commands for each locomotive is also affected by at least one of the car load, braking effort, drawbar/draft gear forces and impact detection.

12. The method of claim 8, wherein the operator interface is a control stand of the Lead Locomotive.

13. The method of claim 8, wherein the input braking and throttle control commands are implemented for the Lead Locomotive and used to determine the translated braking and input control commands that include complimentary control commands for Remote Locomotives that minimize in-train forces and/or improve fuel efficiency.

14. The method of claim 8, wherein the input braking and throttle control commands for the Lead Locomotive are used to determine the translated braking and input control commands that include corresponding control commands for both the Lead Locomotive and the Remote Locomotives to minimize in-train forces and/or improve fuel efficiency.

* * * * *